US009295124B2

(12) United States Patent
Ribarich et al.

(10) Patent No.: US 9,295,124 B2
(45) Date of Patent: Mar. 22, 2016

(54) SYSTEM USING SHUNT CIRCUITS TO SELECTIVELY BYPASS OPEN LOADS

(75) Inventors: Thomas J. Ribarich, Laguna Beach, CA (US); Scott E. Ragona, El Segundo, CA (US)

(73) Assignee: Infineon Technologies Americas Corp., El Segundo, CA (US)

( * ) Notice: Subject to any disclaimer, the term of this patent is extended or adjusted under 35 U.S.C. 154(b) by 196 days.

(21) Appl. No.: 12/804,836

(22) Filed: Jul. 30, 2010

(65) Prior Publication Data

US 2012/0025713 A1 Feb. 2, 2012

(51) Int. Cl.
*H05B 37/00* (2006.01)
*H05B 33/08* (2006.01)

(52) U.S. Cl.
CPC ..... *H05B 33/083* (2013.01); *H05B 33/0893* (2013.01)

(58) Field of Classification Search
USPC ..... 315/119–121, 127–130, 74, 75, 88–91, 315/136
See application file for complete search history.

(56) References Cited

U.S. PATENT DOCUMENTS

| | | | | |
|---|---|---|---|---|
| 4,743,897 | A | 5/1988 | Perez | |
| 5,426,383 | A * | 6/1995 | Kumar | 326/119 |
| 5,528,177 | A * | 6/1996 | Sridhar et al. | 326/113 |
| 6,153,980 | A * | 11/2000 | Marshall et al. | 315/200 A |
| 7,129,751 | B2 * | 10/2006 | Jahan et al. | 326/68 |
| 7,317,403 | B2 * | 1/2008 | Grootes et al. | 340/815.45 |
| 7,649,326 | B2 * | 1/2010 | Johnson et al. | 315/291 |
| 7,782,115 | B2 * | 8/2010 | Ochi | 327/333 |
| 7,994,725 | B2 * | 8/2011 | Bouchard | 315/122 |
| 8,174,212 | B2 * | 5/2012 | Tziony et al. | 315/309 |
| 2007/0257623 | A1 | 11/2007 | Johnson | |

FOREIGN PATENT DOCUMENTS

WO WO 2008129504 10/2008

* cited by examiner

*Primary Examiner* — Douglas W Owens
*Assistant Examiner* — James H Cho
(74) *Attorney, Agent, or Firm* — Farjami & Farjami LLP

(57) ABSTRACT

According to an exemplary embodiment, a shunt circuit includes a floating shunt switch configured to bypass at least one load, for example at least one LED, among a plurality of series-connected loads, such as a plurality of series-connected LEDs in a lighting system, responsive to a high-side control signal. The at least one load has terminals connected across the shunt circuit. The shunt circuit further includes a high-voltage level-shift up circuit configured to shift a low-side control signal up to the high-side control signal using a voltage of at least one of the terminals of the at least one load. The floating shunt switch can be configured to bypass the at least one load responsive to a failure of the at least one load.

20 Claims, 4 Drawing Sheets

SYSTEM USING SHUNT CIRCUITS TO SELECTIVELY BYPASS OPEN LOADS

BACKGROUND OF THE INVENTION

1. Field of the Invention

The present invention is generally in the field of electrical circuits and systems. More particularly, the invention relates to lighting systems utilizing electrical circuits.

2. Background Art

Arrays of connected loads, for example, lighting arrays, or more particularly light emitting diode (LED) arrays, are known and used in a variety of electronic applications, such as in LED displays, color mixing, display backlighting, for example, liquid crystal display (LCD) backlighting, and in general lighting fixtures. The array of connected loads can include a large number of loads, for example, LED displays, such as electronic billboards, can have upwards of one million LEDs. It is generally desirable to connect the large number of LEDs in series resulting in a relatively high-voltage, low-current arrangement. Disadvantageously, when LEDs are connected in series, the failure of one of the LEDs can cause an open circuit, thereby causing a failure of the entire array of series-connected LEDs.

Thus, LED arrays often include a series-parallel arrangement where stings of series-connected LEDs are connected in parallel. However, large arrays of series-parallel connected LEDs often require a large number of parallel connections, particularly in LED displays. Even then the failure of one of the LEDs in a particular string of series-connected LEDs can cause a failure of the entire string of LEDs, which can be especially noticeable when there are a large number of LEDs in the string, for example, in LED displays. Furthermore, having a large number of parallel connections in the series-parallel arrangement can result in high current requirements and increased complexity.

Thus, there is a need in the art for the capability to provide series-connected LED arrays having a large number of LEDs while overcoming the drawbacks and deficiencies in the art.

SUMMARY OF THE INVENTION

A system using shunt circuits to selectively bypass open loads, substantially as shown in and/or described in connection with at least one of the figures, as set forth more completely in the claims.

DETAILED DESCRIPTION OF THE INVENTION

The present invention is directed to a system using shunt circuits to selectively bypass open loads. The following description contains specific information pertaining to the implementation of the present invention. One skilled in the art will recognize that the present invention may be implemented in a manner different from that specifically discussed in the present application. Moreover, some of the specific details of the invention are not discussed in order to not obscure the invention. The specific details not described in the present application are within the knowledge of a person of ordinary skill in the art.

The drawings in the present application and their accompanying detailed description are directed to merely exemplary embodiments of the invention. To maintain brevity, other embodiments of the invention which use the principles of the present invention are not specifically described in the present application and are not specifically illustrated by the present drawings.

Figure 1:
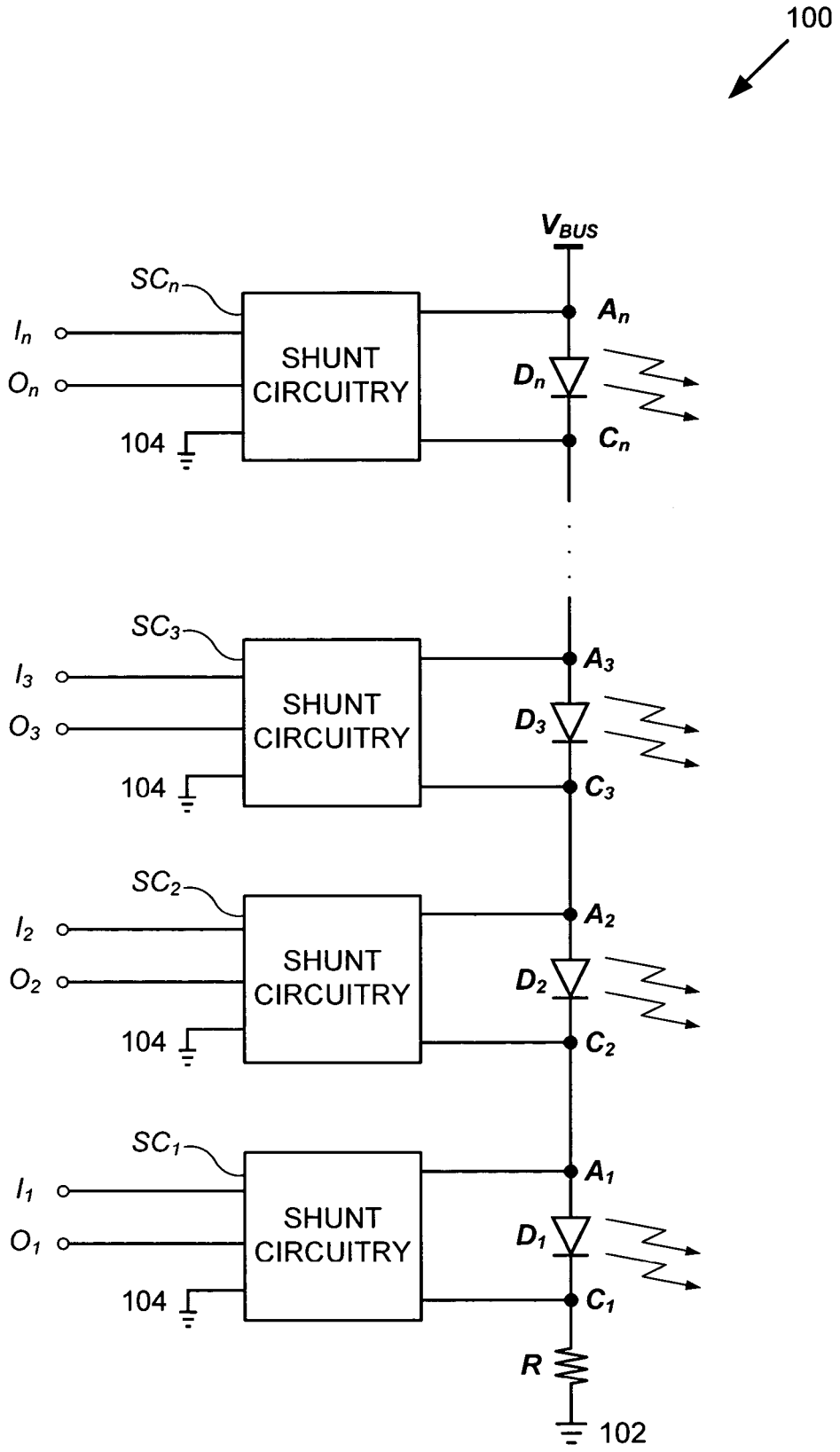
FIG. 1 illustrates an exemplary series-connected LED array including shunt circuitry, according to one embodiment of the invention.

FIG. 1 illustrates an exemplary series-connected LED array (also referred to as a "lighting system" in the present application) including shunt circuitry, according to one embodiment of the invention. As shown in FIG. 1, shunt circuit 100 includes a plurality of LEDs $D_1$, $D_2$, and $D_3$ through $D_n$ (also referred to herein as LEDs $D_1$ through $D_n$). Shunt circuit 100 further includes a plurality of shunt circuitry $SC_1$, $SC_2$, and $SC_3$ through $SC_n$ (also referred to herein as shunt circuitry $SC_1$ through $SC_n$).

Further shown in FIG. 1, LEDs $D_1$ through $D_n$ are connected in series between source voltage $V_{BUS}$ and ground 102. Each shunt circuitry $SC_1$ through $SC_n$ is connected to ground 104 and is connected across a respective LED $D_1$ through $D_n$. More particularly, each shunt circuitry $SC_1$ through $SC_n$ is connected to respective terminal nodes of LEDs $D_1$ through $D_n$, which are represented as anode and cathode nodes in FIG. 1. For example, shunt circuitry $SC_1$ is connected to anode node $A_1$ and cathode node $C_1$ of LED $D_1$.

In shunt circuit 100, each shunt circuitry $SC_1$ through $SC_n$ can bypass a respective LED $D_1$ through $D_n$, for example, by allowing current to flow into the shunt circuitry between a respective anode node $A_1$ through $A_n$ and a respective cathode node $C_1$ through $C_n$, circumventing a respective LED $D_1$ through $D_n$. More particularly, each shunt circuitry $SC_1$ through $SC_n$ can bypass a respective LED $D_1$ though $D_n$ to avoid failure of series-connected LEDs $D_1$ though $D_n$. For example, during an open-load condition (i.e., where there is an open circuit between at least one of anode nodes $A_1$ through $A_n$ and a respective cathode node $C_1$ through $C_n$) each shunt circuitry $SC_1$ through $SC_n$ can bypass a respective failed LED $D_1$ through $D_n$ thereby preventing the failure of the entire array of LEDs. In some embodiments shunt circuitry $SC_1$ through $SC_n$ each can signal failure of a respective LED $D_1$ through $D_n$ using a respective output node $O_1$ through $O_n$. Furthermore, in some embodiments, each shunt circuitry $SC_1$ through $SC_n$ can also bypass a respective LED $D_1$ through $D_n$ selectively regardless of failure of the LED, for example, responsive to a signal received at a respective input node $I_1$ through $I_n$.

FIG. 1 is shown and described with respect to each shunt circuitry $SC_1$ through $SC_n$ connected across one load, a respective LED $D_1$ through $D_n$. However, it will be appreciated that each shunt circuitry $SC_1$ through $SC_n$ can be connected across multiple loads, for example, multiple series-connected LEDs. Thus, shunt circuit 100 can have reduced shunt circuitry, thereby reducing cost. Furthermore, while shunt circuitry $SC_1$ through $SC_n$ are shown as discrete units in FIG. 1 for simplicity, it will be appreciated that in some embodiments shunt circuitry $SC_1$ through $SC_n$ can be integrated with each other and/or additional circuitry.

Figure 2:
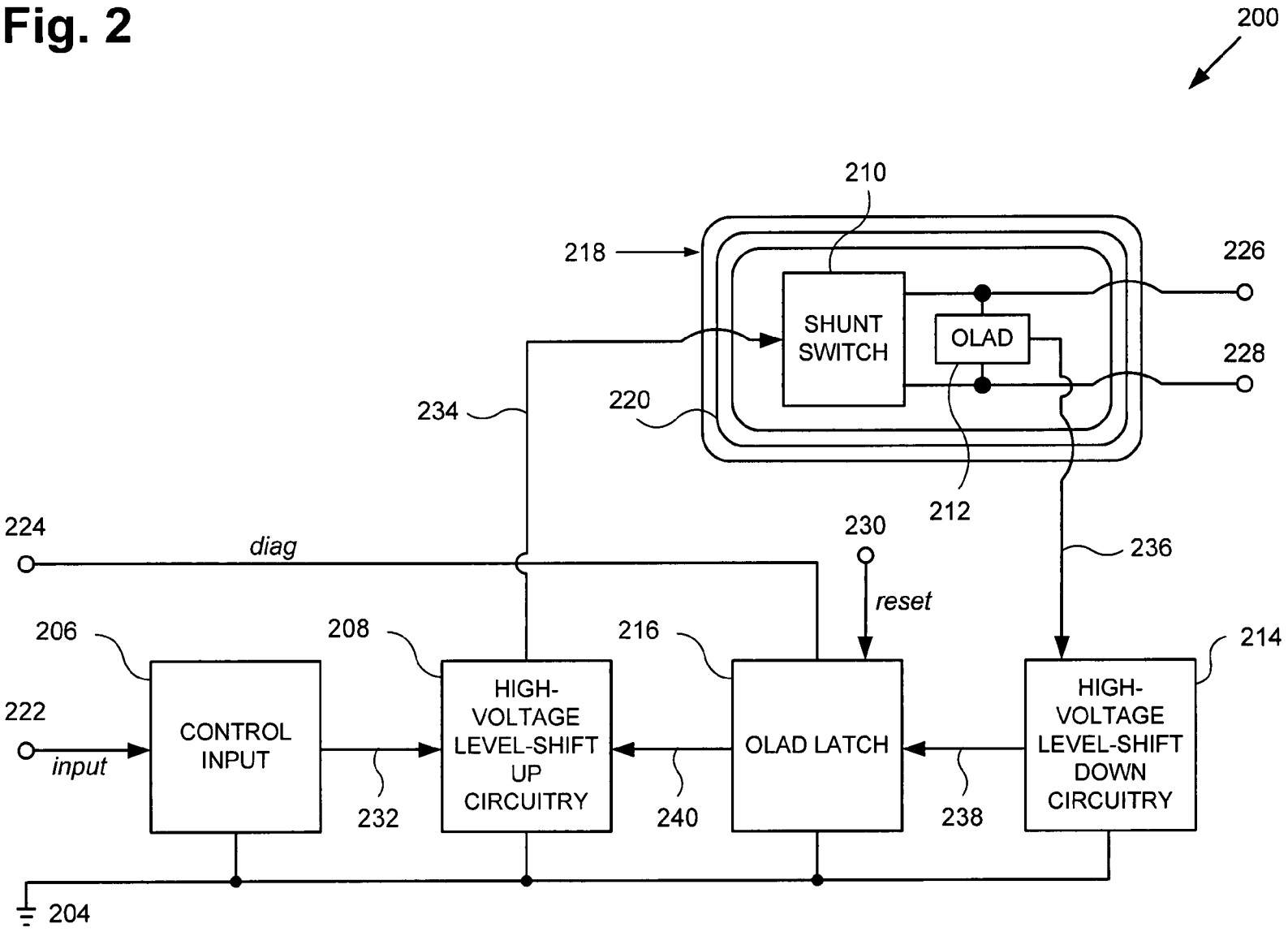
FIG. 2 shows an overview of exemplary shunt circuitry, corresponding to shunt circuitry in the series-connected LED array shown in FIG. 1, according to one embodiment of the invention.

Referring now to FIG. 2, FIG. 2 shows an overview of exemplary shunt circuitry, corresponding to shunt circuitry in FIG. 1, according to one embodiment of the invention. In FIG. 2 shunt circuitry 200 can correspond to any of shunt circuitry $SC_1$ through $SC_n$ in FIG. 1. Shunt circuitry 200 includes control input 206, high-voltage level-shift up circuitry 208, shunt switch 210, open-load auto-detector (OLAD) 212, high-voltage level-shift down circuitry 214, and OLAD latch 216. Shunt circuitry 200 further includes input node 222 and diagnostics node 224, which can correspond respectively to one of input nodes $I_1$ through $I_n$ and output nodes $O_1$ through $O_n$ in a respective shunt circuitry $SC_1$ through $SC_n$ in FIG. 1. Shunt circuitry 200 also includes shunting node 226 and shunting node 228, which can be connected respectively to one of anode nodes $A_1$ through $A_n$ and cathode nodes $C_1$ through $C_n$ of a respective LED $D_1$ through $D_n$ in FIG. 1.

Shunt circuitry 200 has low-side circuitry comprising control input 206, high-voltage level-shift up circuitry 208, high-voltage level-shift down circuitry 214, and OLAD latch 216 connected to ground 204, corresponding to ground 104 in FIG. 1. Shunt circuitry 200 also has high-side circuitry comprising shunt switch 210 and OLAD 212. As shown in FIG. 2, shunt switch 210 and OLAD 212 are connected between shunting nodes 226 and 228. By enabling shunt switch 210, shunt circuitry 200 can bypass a load connected across shunting nodes 226 and 228 in the series-connected array of loads.

In shunt circuitry 200, shunt switch 210 can be enabled or disabled responsive to a low-side control signal provided by the low-side circuitry. The low-side control signal can be a ground-based signal, which can be, for example, 0 to 5 volts. In the present example, the low-side control signal can be low-side control signal 240 from OLAD latch 216 to enable shunt switch 210 responsive to an open-load condition or it can be low-side control signal 232 from control input 206 to selectively enable shunt switch 210 regardless of an open-load condition.

As shown in FIG. 2, control input 206 is configured to provide low-side control signal 232 to high-voltage level-shift up circuitry 208 to selectively enable shunt switch 210 responsive to an input signal from input node 222. The input signal can be provided to input node 222 by a control device, such as, a microcontroller or pulse width modulator (not shown in FIG. 1). Shunt switch 210 can be selectively enabled, for example, in light dimming applications.

Also in shunt circuitry 200, OLAD latch 216 is configured to provide low-side control signal 240 to high-voltage level-shift up circuitry 208 to enable shunt switch 210 responsive to an open-load condition, which can be detected by OLAD 212. As shown in FIG. 2, OLAD 212 is connected across shunting nodes 226 and 228. Thus, OLAD 212 can detect an open-load condition across shunting nodes 226 and 228, which can occur, for example, when a load connected across shunting nodes 226 and 228 fails.

When OLAD 212 detects an open-load condition, high-side open-load signal 236 is provided to high-voltage level-shift down circuitry 214. High-voltage level-shift down circuitry 214 level-shifts high-side open-load signal 236 down to low-side open-load signal 238. In turn, low-side open-load signal 238 is provided to OLAD latch 216 to set OLAD latch 216 to provide low-side control signal 240 to high-voltage level-shift up circuitry 208.

Also shown in FIG. 2, in some embodiments, shunt circuitry 200 includes diagnostics node 224 and reset node 230, which can be connected to an external controller device, for example, a microcontroller. Diagnostics node 224 can provide a diagnostic signal from OLAD latch 224, indicating that OLAD latch 216 is providing low-side control signal 240 to high-voltage level-shift up circuitry 208 to enable shunt switch 210. Reset node 230 can provide a reset signal to OLAD latch 216 to reset OLAD latch 216, for example, after an open-load condition where OLAD latch 216 is providing low-side control signal 240 to high-voltage level-shift up circuitry 208 to enable shunt switch 210.

Notably, shunt switch 210 is floating and is controlled by level-shifting a low-side control signal up to high-side control signal 234 using a terminal voltage of a load connected across shunt circuitry 200. As described above, in the present embodiment, the low-side control signal can be low-side control signal 240 from OLAD latch 216 to enable shunt switch 210 responsive to an open-load condition or it can be low-side control signal 232 from control input 206 to selectively enable shunt switch 210. The operation of high-voltage level-shift up circuitry 208 and shunt switch 210 will be described in more detail with respect to FIG. 3.

Figure 3:
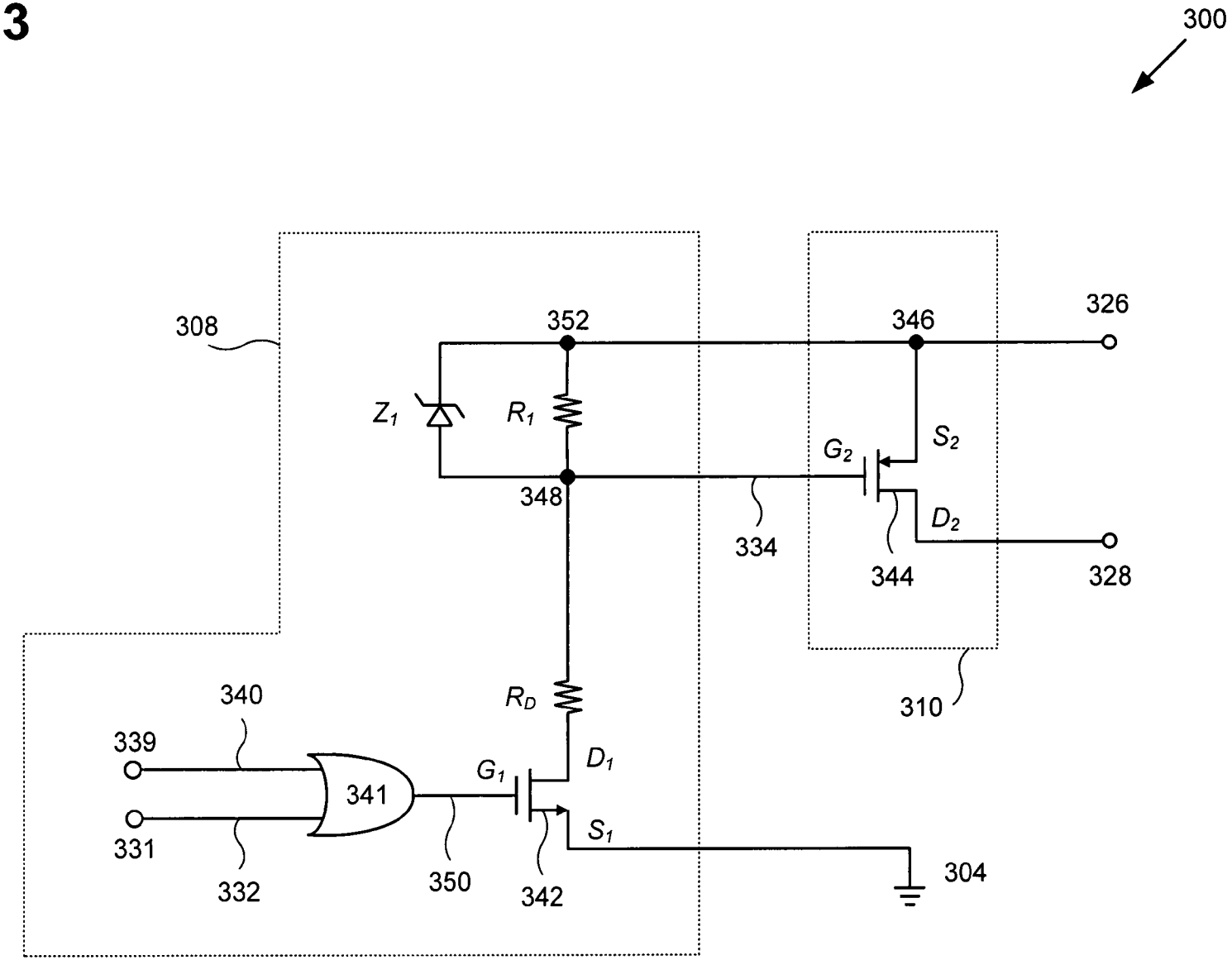
FIG. 3 shows exemplary shunt switch and high-voltage level shift-up circuitry corresponding to shunt circuitry shown in FIG. 2, according to one embodiment of the invention.

Referring to FIG. 3, FIG. 3 shows exemplary high-voltage level-shift up circuitry 308 and shunt switch 310, which can correspond respectively to high-voltage level-shift up circuitry 208 and shunt switch 210 in FIG. 2.

As shown in FIG. 3, high-voltage level-shift up circuitry 308 includes OR gate 341, resistor $R_1$, zener diode $Z_1$, and N channel field effect transistor (NFET) 342 having internal drain resistance $R_D$. High-voltage level-shift up circuitry 308 also includes node 331 for receiving low-side control signal 332, corresponding to low-side control signal 232 in FIG. 2 and node 339 for receiving low-side control signal 340, corresponding to low-side control signal 240 in FIG. 2. Node 331 can be connected to control input 206 and node 339 can be connected to OLAD latch 216 in FIG. 2. High-voltage level-shift up circuitry 308 further includes node 348 for providing high-side control signal 334 to shunt switch 310, which corresponds to high-side control signal 234 in FIG. 2.

In FIG. 3, OR gate 341 is configured to receive low-side control signals 332 and 340 and to output low-side control signal 350 to gate $G_1$ of NFET 342. NFET 342 is connected between node 348 and ground 304, which can correspond to ground 204 in FIG. 2. More particularly, in the present embodiment, source $S_1$ of NFET 342 is connected to ground 304 and drain $D_1$ of NFET 342 is connected to node 348. Resistor $R_1$ and zener diode $Z_1$ are connected between nodes 352 and 348 in parallel arrangement.

Also in FIG. 3, shunt switch 310 includes P channel field effect transistor (PFET) 344. In shunt switch 310, source $S_2$ of PFET 344 is connected to node 352 of high-voltage level-shift up circuitry 308 at node 346 and gate $G_2$ of PFET 344 is connected to node 348 of high-voltage level-shift up circuitry 308. Also in shunt switch 310, drain $D_2$ is connected to shunting node 328, corresponding to shunting node 228 in FIG. 2 and source $S_2$ of PFET 344 is connected to shunting node 326, corresponding to shunting node 226 in FIG. 2 at node 346.

Shunt switch 310 can be enabled or disabled responsive to low-side control signal 350. In the present example, low-side control signal 350 will disable shunt switch 310 when both low-side control signals 340 and 332 are low, for example, around 0 volts. Low-side control signal 340 can be low when no open-load condition has been detected, for example, by OLAD 212 in FIG. 2. Low-side control signal 332 can be low when shunt switch 310 is being selectively disabled, for example, responsive to the input signal received at input node 222 in FIG. 2.

When shunting nodes 326 and 328 are connected across the terminals of a load (e.g. the anode and cathode of an LED) in a series-connected array of loads, circuitry 300 is configured to disable shunt switch 310 (e.g. PFET 344) when NFET 342 is disabled, such that the load is not bypassed. In operation, when low-side control signal 350 is low, for example, around 0 volts, $V_{GS}$ of NFET 342 is approximately 0 volts, and NFET 342 is OFF. The voltage at node 348 will be approximately equal to the voltage at node 346, which is equal to the voltage of a terminal of the load connected to shunting node 326. Thus, $V_{GS}$ of PFET 344 can be around 0 volts and PFET 344 is also OFF. As such, shunt switch 310 is disabled and current can flow through the load connected between shunting nodes 326 and 328.

Furthermore, in the present example, low-side control signal 350 will enable shunt switch 310 when at least one of low-side control signals 340 and 332 are high, for example, around 5 volts. Low-side control signal 340 can be high when an open-load condition has been detected, for example, by OLAD 212 in FIG. 2. Low-side control signal 332 can be high when shunt switch 310 is selectively enabled, for example, responsive to the input signal received at input node 222 in FIG. 2.

Circuitry 300 is configured to enable shunt switch 310 (e.g. PFET 344) when NFET 342 is enabled, such that the load is bypassed in the array of series-connected loads. When low-side control signal 350 is high, for example, around 5 volts, $V_{GS}$ of NFET 342 is approximately 5 volts and NFET 342 is ON. Thus, node 348 will be connected to ground 304 through resistor $R_D$, which is internal resistance of drain $D_1$ of NFET 342. The voltage at node 348 will be pulled down to ground 304 subject to the parallel arrangement of zener diode $Z_1$ and resistor $R_1$ to avoid damaging circuitry 300. For example, the parallel arrangement of zener diode $D_1$ and resistor $R_1$ can prevent node 348 from falling below approximately 15 volts in some embodiments, although that voltage can be selected to always be less than the voltage across shunting nodes 326 and 328 during an open-load condition. The voltage at node 346 will be at the voltage of a terminal of the load connected to shunting node 326, which is greater than the voltage at node 348, for example, greater than 15 volts, such that $V_{GS}$ of PFET 344 is less than 0 volts. As such, shunt switch 310 is enabled and current can flow through shunt switch 310 connected between shunting nodes 326 and 328. For example, in a particular instance, where circuitry 300 is in shunt circuitry $SC_n$ in FIG. 1, node 348 can be 15 volts and source voltage $V_{BUS}$ (and thus source $S_2$) can be around 600 volts. Thus, $V_{GS}$ can be around −585 volts, enabling PFET 344.

Thus, shunt switch 310 is floating and is controlled by level-shifting low-side control signal 350 up to high-side control signal 234 using a terminal voltage of the load at shunting node 326. According to the present invention, each LED $D_1$ through $D_n$ can be independently bypassed regardless of the voltage across its terminals while conveniently being controlled by the low-side circuitry. The terminal voltages can vary as other loads in the series-connected array are bypassed. For example, any of anode nodes $A_1$ through $A_n$ in FIG. 1 can be near source voltage $V_{BUS}$ depending on which LEDs $D_1$ through $D_n$ are bypassed. Thus, in some embodiments, NFET 342 in each shunt circuitry $SC_1$ through $SC_n$ should be capable of withstanding voltages near source voltage $V_{BUS}$. As such, in some embodiments, NFET 342 may comprise a high-voltage III-nitride device, such as a GaN FET or GaN HEMT. Furthermore, the voltages in the high-side circuitry in FIG. 2 can be much greater than the voltages in the low-side circuitry in FIG. 2 and should be isolated from the low-side circuitry.

Referring again to FIG. 2, floating isolation well 218 is configured to isolate the high-side circuitry of shunt circuitry 200 from the low-side circuitry of shunt circuitry 200. As such, floating isolation well 218 comprises a high-voltage isolation well. While shunt circuitry 200 includes floating isolation well 218, in other embodiments, the high-voltage circuitry of shunt circuitry 200 can be isolated from the low-voltage circuitry of shunt circuitry 200 using other isolation means.

Floating isolation well 218 includes floating isolation rings, such as, isolation ring 220, which can withstand high voltages between the inside and the outside of floating isolation well 218. In one embodiment, each floating isolation well 218 in a respective shunt circuitry $SC_1$ through $SC_n$ in FIG. 1 should be capable of isolating voltages approaching source voltage $V_{BUS}$.

Figure 4:
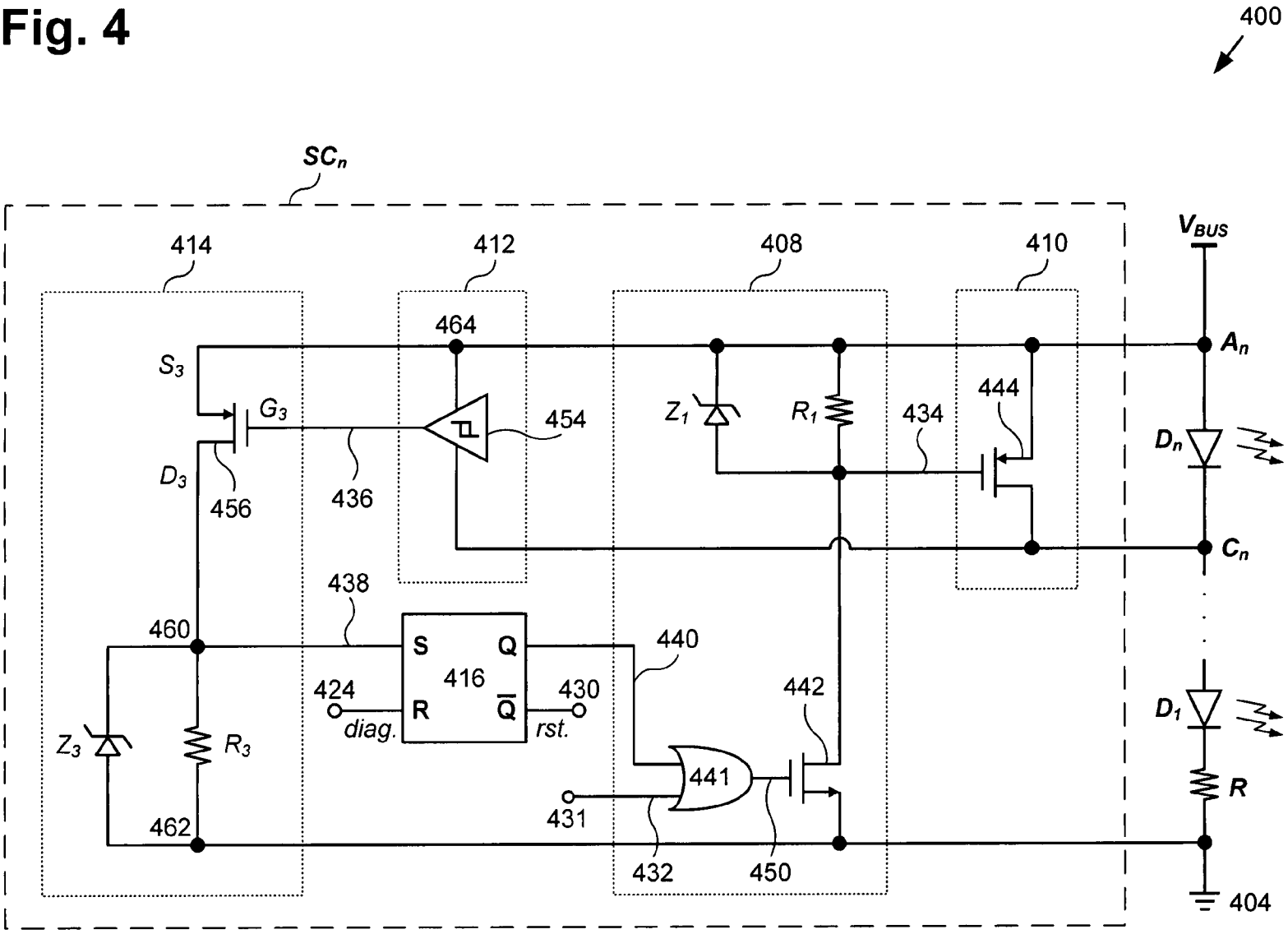
FIG. 4 shows an exemplary implementation of shunt circuitry in a series-connected LED array, according to one embodiment of the invention.

Referring now to FIG. 4, FIG. 4 shows an exemplary implementation of shunt circuitry in a series-connected LED array, which can correspond to shunt circuit 100 in FIG. 1. Shunt circuit 400 includes shunt circuitry $SC_n$, which can correspond to shunt circuitry $SC_n$ in FIG. 1. Shunt circuitry $SC_n$ includes high-voltage level-shift up circuitry 408, shunt switch 410, OLAD 412, low-voltage level-shift down circuitry 414, and latch 416 corresponding respectively to high-voltage level-shift up circuitry 208, shunt switch 210, OLAD 212, low-voltage level-shift down circuitry 214, and latch 216 in FIG. 2. High-voltage level-shift up circuitry 408 and shunt switch 410 further correspond respectively to high-voltage level-shift up circuitry 308 and shunt switch 310 in FIG. 3. For example, similarly labeled features in FIGS. 3 and 4 correspond with one another, and thus, will not be described in detail with respect to FIG. 4.

FIG. 4 also shows low-side control signals 440 and 432 corresponding respectively to low-side control signals 340 and 332 in FIG. 3 and low-side control signals 240 and 232 in FIG. 2. As described above, shunt switch 410 can be controlled by low-side control signal 450. In the present example, low-side control signal 450 will disable shunt switch 410 (i.e. bypass LED $D_n$) when both low-side control signals 440 and 432 are low and will enable shunt switch 410 when at least one of low-side control signals 440 and 432 are high.

Low-side control signal 432, which is received at node 431 in FIG. 4, can be high or low responsive to the input signal received at input node 222 in FIG. 2, for example, to selectively enable shunt switch 410.

Low-side control signal 440, which is received from OLAD latch 416, can be low or high responsive to an open-load condition, which can be detected, for example, by OLAD 412. As shown in FIG. 4, OLAD 412 comprises Schmitt trigger 454, which is connected across anode node $A_n$ and cathode node $C_n$ of LED $D_n$. If LED $D_n$ fails, for example, during an open-load condition, the voltage across anode node $A_n$ and cathode node $C_n$ increases, which can be detected by Schmitt trigger 454 connected across anode node $A_n$ and cathode node $C_n$.

When OLAD 412 is detecting an open-load condition, high-side open-load signal 436, which corresponds to high-side open-load signal 236 in FIG. 2, is low and is provided to low-side level-shift down circuitry 414. More particularly, when the voltage across anode node $A_n$ and cathode node $C_n$, exceeds a particular threshold, Schmitt trigger 454 can provide high-side open-load signal 436, which is low, to low-side level-shift down circuitry 414. As an example, the voltage threshold can be around 10 volts.

Low-side level-shift down circuitry 414 can level-shift high-side open-load signal 436 down to low-side open-load signal 438, corresponding to low-side open-load signal 238 in FIG. 2. In FIG. 4, low-side level-shift down circuitry 414 includes PFET 456 resistor $R_3$ and zener diode $Z_3$. As shown in FIG. 4, source $S_3$ of PFET 456 is connected to anode node $A_n$ of LED $D_n$ and gate G3 of PFET 456 is connected to the output of Schmitt trigger 454. Thus, during operation, source $S_3$ is connected to a high-voltage, such as source voltage $V_{BUS}$ in the present example.

When OLAD 412 is not detecting an open-load condition, high-side open load signal 436 from Schmitt Trigger 454 will be near anode node $A_n$, thus $V_{GS}$ of PFET 456 will be approximately 0 volts and PFET 456 will be OFF. As such, node 460 will be low. However, when OLAD 412 is detecting an open-load condition, high-side open load signal 436 from Schmitt Trigger 454 is low, for example, near 0 volts to enable PFET 456. When PFET 456 is enabled, the voltage at anode node $A_n$ will be pulled down by ground 404, subject to the parallel arrangement of resistor $R_3$ and zener diode $Z_3$, which is connected between ground 404 and drain $D_3$ of PFET 456. As such, node 460 will be high. In some embodiments node 460 can be around 5 volts.

OLAD latch 416 can receive low-side open-load signal 438 from low-voltage level-shift up circuitry 414 to set OLAD latch 416 when low-side open-load signal 438 is high. Thereafter, OLAD latch 416 can provide low-side control signal 440, which is high, to high-voltage level-shift up circuitry 408 to disable shunt switch 410.

Thus, as discussed above, in the embodiments of FIGS. 1 through 4, the invention provides for a series-connected array of loads, such as series-connected LED arrays, where particular loads can be bypassed. In various embodiments the loads can be bypassed selectively or in response to an open-load condition while avoiding failure of the series-connected array. A load can be bypassed using shunt circuitry including a floating shunt switch, which is controlled by level-shifting a low-side control signal up to a high-side control signal using a terminal voltage of the load connected across the shunt circuitry. According to the present invention, each load in the array can be independently bypassed regardless of the voltage across its terminals while conveniently being controlled by low-side circuitry.

From the above description of the invention it is manifest that various techniques can be used for implementing the concepts of the present invention without departing from its scope. Moreover, while the invention has been described with specific reference to certain embodiments, a person of ordinary skill in the art would appreciate that changes can be made in form and detail without departing from the spirit and the scope of the invention. Thus, the described embodiments are to be considered in all respects as illustrative and not restrictive. It should also be understood that the invention is not limited to the particular embodiments described herein but is capable of many rearrangements, modifications, and substitutions without departing from the scope of the invention.

The invention claimed is:

1. A shunt circuit for bypassing at least one load among a plurality of series-connected loads, said shunt circuit comprising:

a shunt switch configured to bypass at least one load among a plurality of series-connected loads responsive to a high-side control signal, said at least one load having its terminals connected across said shunt circuit;

a high-voltage level-shift up circuit configured to receive a first low-side control signal at a first OR gate input node and a second low-side control signal at a second OR gate input node, and shift a third low-side control signal up to said high-side control signal, said high-side control signal being referenced to a voltage of a positive one of said terminals of said at least one load.

2. The shunt circuit of claim 1, wherein said at least one load comprises at least one light emitting diode (LED).

3. The shunt circuit of claim 1, wherein said shunt switch is configured to bypass said at least one load responsive to a failure of said at least one load.

4. The shunt circuit of claim 1, wherein said shunt switch is configured to selectively bypass said at least one load.

5. The shunt circuit of claim 1, wherein said high-voltage level-shift up circuit comprises an N channel field effect transistor configured to receive said third low-side control signal.

6. The shunt circuit of claim 1, wherein said high-voltage level-shift up circuit comprises a GaN field effect transistor configured to receive said third low-side control signal.

7. The shunt circuit of claim 1, wherein said shunt switch comprises a P channel field effect transistor configured to receive said high-side control signal.

8. The shunt circuit of claim 1, comprising an open-load detection circuit configured to provide a high-side open-load signal indicating an open-load across said terminals of said at least one load.

9. The shunt circuit of claim 8, wherein said open-load detection circuit comprises a Schmitt trigger coupled across said terminals of said at least one load.

10. The shunt circuit of claim 1, wherein said shunt switch is disposed within a floating isolation well.

11. A lighting system comprising an array comprising a plurality of series-connected light emitting diodes (LEDs), said lighting system utilizing a shunt circuit comprising:

a plurality of shunt switches each connected across terminals of a respective LED among said plurality of series-connected LEDs;

each of said plurality of shunt switches being configured to bypass said respective LED responsive to a high-side control signal, said high-side control signal being level-shifted up from an output signal of an OR gate receiving a first low-side control signal from a first node and a second low-side control signal from a second node, said high-side control signal being referenced to a voltage of a positive one of said terminals of said respective LED.

12. The lighting system of claim 11, wherein each of said plurality of shunt switches is configured to bypass said respective LED responsive to a failure of said respective LED.

13. The lighting system of claim 11, wherein each of said plurality of shunt switches is configured to selectively bypass said respective LED.

14. The lighting system of claim 11, wherein said high-side control signal is level-shifted up from said output signal of said OR gate using an N channel field effect transistor configured to receive said output signal of said OR gate.

15. The lighting system of claim 11, wherein said high-side control signal is level-shifted up from said output signal of said OR gate using a GaN field effect transistor configured to receive said output signal of said OR gate.

16. The lighting system of claim 11, wherein each of said plurality of shunt switches comprises a P channel field effect transistor configured to receive said high-side control signal.

17. The lighting system of claim 11, comprising a plurality of open-load detection circuits each configured to provide a respective high-side open-load signal indicating an open-load across said terminals of said respective LED.

18. The lighting system of claim 17, wherein said open-load detection circuit comprises a Schmitt trigger connected across said terminals of said respective LED.

19. The lighting system of claim 11, wherein each of said plurality of shunt switches is disposed within a floating isolation well.

20. A shunt circuit for bypassing at least one load among a plurality of series-connected loads, said shunt circuit comprising:

a shunt switch configured to bypass at least one load among a plurality of series-connected loads responsive to a high-side control signal, said at least one load having its terminals connected across said shunt circuit;

a high-voltage level-shift up circuit configured to shift at least one of a first low-side control signal from a first node and a second low-side control signal from a second node different from said first node up to said high-side control signal;

an open-load detection circuit configured to provide a high-side open-load signal indicating an open-load across said terminals of said at least one load.

* * * * *